US008565845B2

(12) United States Patent
Kobayashi et al.

(10) Patent No.: US 8,565,845 B2
(45) Date of Patent: Oct. 22, 2013

(54) SUPERCONDUCTING COIL AND SUPERCONDUCTING CONDUCTOR FOR USE THEREIN

(75) Inventors: Shinichi Kobayashi, Osaka (JP); Tetsuyuki Kaneko, Osaka (JP)

(73) Assignee: Sumitomo Electric Industries, Ltd., Osaka-shi, Osaka (JP)

( * ) Notice: Subject to any disclaimer, the term of this patent is extended or adjusted under 35 U.S.C. 154(b) by 551 days.

(21) Appl. No.: 12/293,143

(22) PCT Filed: Feb. 6, 2008

(86) PCT No.: PCT/JP2008/051950

§ 371 (c)(1), (2), (4) Date: Sep. 16, 2008

(87) PCT Pub. No.: WO2008/093883

PCT Pub. Date: Aug. 7, 2008

(65) Prior Publication Data

US 2009/0093370 A1 Apr. 9, 2009

(30) Foreign Application Priority Data

Apr. 20, 2007 (JP) ..... 2007-111369

(51) Int. Cl.
*H01F 6/06* (2006.01)
*H01B 12/02* (2006.01)

(52) U.S. Cl.
USPC ..... 505/211; 505/705; 505/844; 505/879; 174/125.1; 335/216; 335/296

(58) Field of Classification Search
USPC ..... 505/230, 231, 211, 100, 430, 705, 924, 505/844; 174/125.1; 29/599
See application file for complete search history.

(56) References Cited

U.S. PATENT DOCUMENTS 6,253,096 B1 6/2001 Balachandran et al.
2004/0082482 A1* 4/2004 Rey ..... 505/100

FOREIGN PATENT DOCUMENTS

JP 04-324209 * 11/1992
JP 6-275146 9/1994
JP 11-186025 7/1999

(Continued)

OTHER PUBLICATIONS

Naoki Ayai et al., "Achievement of HTS Wire Critical Current Exceeding 200 A", SEI Technical Review, Jul. 2006, pp. 103-108, No. 169, Sumitomo Electric Industries, Japan, including English abstract.

(Continued)

*Primary Examiner* — Stanley Silverman
*Assistant Examiner* — Kallambella Vijayakumar
(74) *Attorney, Agent, or Firm* — Drinker Biddle & Reath LLP

(57) ABSTRACT

The invention offers a superconducting coil that has the shape of a pancake formed by winding a superconducting conductor. The superconducting conductor is composed of a tape-shaped (Bi, Pb)2223-based superconducting wire and a tape-shaped thin-film RE123-based superconducting wire that are electrically connected in parallel with each other. The coil generates only a low voltage in the steady-operation state, limits the generated voltage to a low level even in a state where an external disturbance enters for some reason, and is therefore less susceptible to quenching. Consequently, the coil can be operated stably in both states. The invention also offers a superconducting conductor to be used to form the coil.

6 Claims, 5 Drawing Sheets

(56) References Cited

FOREIGN PATENT DOCUMENTS

| | | | |
|---|---|---|---|
| JP | 2004-273145 | | 9/2004 |
| JP | 2004-528712 | | 9/2004 |
| JP | 2005-050560 | | 2/2005 |
| JP | 2005050560 | * | 2/2005 |
| WO | WO 95/20826 | | 11/1997 |

OTHER PUBLICATIONS

Munetsugu Ueyama et al., "Development of HoBCO Coated Conductor", SEI Technical Review, Jul. 2006, pp. 109-112, No. 169, Sumitomo Electric Industries, Japan, including English abstract.

Extended European Search Report dated Mar. 7, 2013 from the European Patent Office from Application No. EP 08 71 0846.

* cited by examiner

SUPERCONDUCTING COIL AND SUPERCONDUCTING CONDUCTOR FOR USE THEREIN

TECHNICAL FIELD

The present invention relates to a superconducting coil, particularly to a structure of a superconducting coil that can be operated stably because it has a property of generating only a low voltage even when an external disturbance enters.

BACKGROUND ART

Researchers and engineers have been intensely developing the following two types of superconducting wire as the one using an oxide superconducting material. One is a tape-shaped silver-sheathed superconducting wire that is produced by the power-in-tube method and that is mainly composed of a $(Bi, Pb)_2Sr_2Ca_2Cu_3O_{10\pm\delta}$ ("δ" is a number of 0.1 or so, and hereinafter referred to as (Bi, Pb)2223) phase (see, for example, Nonpatent literature 1). The other one is a tape-shaped thin-film superconducting wire produced by forming a superconducting layer on a metallic substrate by using the gas phase method or the liquid phase method. The superconducting material in the thin-film superconducting wire is an oxide superconducting material expressed as the chemical formula $RE_1Ba_2Cu_3O_x$ ("x" is a number close to 7, and hereinafter referred to as RE123). In the above formula, RE (rare earth) represents one of the rare-earth elements, such as Y, Ho, Nd, Sm, Dy, Eu, La, and Tm, or a mixture of them. (See, for example, Nonpatent literature 2.)

A superconducting coil to be used in a magnetic field has been produced by using the above-described superconducting wire. Patent literature 1 has disclosed a superconducting coil formed by stacking in layers a plurality of pancake coils that use a tape-shaped (Bi, Pb)2223-based superconducting wire. The superconducting coil produced by using the tape-shaped (Bi, Pb)2223-based superconducting wire is cooled to a temperature as low as 20 K or below to carry an intended operating current to generate a magnetic field.

The (Bi, Pb)2223-based superconducting wire has not sufficient resistance to a magnetic field. Consequently, when a magnetic field is applied, its critical-current value decreases significantly. A coil formed with the wire decreases its critical-current value even by the magnetic field generated by the coil itself. As a result, the operating temperature is reduced to increase the critical-current value so that a sufficient superconducting current can be fed into the coil even in the generated magnetic field. As described above, when a comparatively high magnetic field is intended to generate in a superconducting coil composed of the tape-shaped (Bi, Pb)2223-based superconducting wire, it is necessary to cool the superconducting coil to a temperature as low as 20 K or so.

On the other hand, the tape-shaped thin-film RE123-based superconducting wire has a higher resistance to a magnetic field than that of the (Bi, Pb)2223-based superconducting wire. Consequently, it has a high critical-current value even at a relatively high temperature in a magnetic field. This feature enables the formation of a superconducting coil that generates a high magnetic field even at high temperatures. In addition, in a current-voltage characteristic in a superconducting state expressed as $V \propto I^n$ (V: voltage, I: current), the RE123-based wire has a high n-value, which is the exponential number to the current. In other words, it is a wire in which the voltage varies sensitively to the variation in the current. When a superconducting coil is formed, the high n-value becomes not only advantageous but also disadvantageous.

When a superconducting coil composed of a wire having a high n-value is operated at a current not more than its critical current, the generated voltage is extremely low and therefore the heat generated in the superconducting coil is small. On the other hand, when the operating current exceeds the critical-current value due to, for example, the temperature rise resulting from the entering of an external disturbance for some reason, a high voltage is generated and consequently a large amount of heat is generated. This heat generation causes the quenching phenomenon in the superconducting coil. When the quenching phenomenon occurs excessively, the superconducting wire will be burnt out and the superconducting coil may be broken.

Patent literature 1: the Japanese patent application Tokuganhei 10-104911 (the published Japanese patent application Tokukaihei 11-186025)

Nonpatent literature 1: SEI Technical Review (SEI: Sumitomo Electric Industries), July 2006, No. 169, pp. 103 to 108

Nonpatent literature 2: SEI Technical Review, July 2006, No. 169, pp. 109 to 112.

DISCLOSURE OF THE INVENTION

Problem to be Solved by the Invention

In view of the above-described circumstances, an object of the present invention is to offer a superconducting coil that generates only a low voltage in the steady-operation state, that limits the generated voltage to a low level even when an external disturbance enters for some reason, and that is therefore less susceptible to quenching and to offer a superconducting conductor to be used to form the coil.

Means to Solve the Problem

The present inventors have studied in detail the properties of the (Bi, Pb)2223-based superconducting wire and the RE123-based superconducting wire. By combining the advantages of both wires, the present inventors have completed an invention that can achieve the above-described object. The present invention is explained below.

The present invention offers a superconducting coil that has the shape of a pancake formed by winding a superconducting conductor. The superconducting conductor is composed of a tape-shaped (Bi, Pb)2223-based superconducting wire and a tape-shaped thin-film RE123-based superconducting wire that are electrically connected in parallel with each other.

According to the present invention, it is desirable that the tape-shaped (Bi, Pb)2223-based superconducting wire and the tape-shaped thin-film RE123-based superconducting wire have the same width.

According to the present invention, when the tape-shaped (Bi, Pb)2223-based superconducting wire has a first critical-current value at an operating temperature and magnetic field and the tape-shaped thin-film RE123-based superconducting wire has a second critical-current value at the operating temperature and magnetic field, it is desirable that the ratio of the first critical-current value to the second critical-current value be at least 0.8 and at most 1.25.

According to the present invention, it is desirable that the tape-shaped (Bi, Pb)2223-based superconducting wire be mechanically bonded with the tape-shaped thin-film RE123-based superconducting wire throughout its length.

According to the present invention, it is desirable that in the same turn of the coil, the tape-shaped thin-film RE123-based superconducting wire be wound at the outer side.

According to the present invention, the tape-shaped thin-film RE123-based superconducting wire has a superconducting layer, and it is desirable that the superconducting-layer side of the tape-shaped thin-film RE123-based superconducting wire be positioned so as to face the tape-shaped (Bi, Pb)2223-based superconducting wire.

The present invention also offers a superconducting conductor to be used for any of the above-described superconducting coils. The superconducting conductor is composed of a tape-shaped (Bi, Pb)2223-based superconducting wire and a tape-shaped thin-film RE123-based superconducting wire that are electrically connected in parallel with each other.

Effect of the Invention

The present invention can offer a superconducting coil that generates only a low voltage in the steady-operation state, that limits the generated voltage to a low level even when an external disturbance enters for some reason, and that is therefore less susceptible to quenching.

Explanation of the Sign

Figure 1:
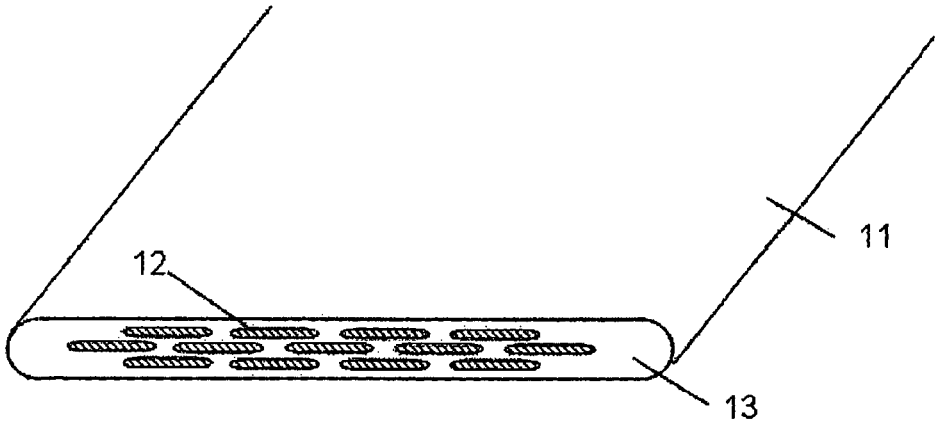
FIG. 1 is a partly cross-sectional perspective view schematically showing the structure of a tape-shaped (Bi, Pb)2223-based superconducting wire.

11: Tape-shaped (Bi, Pb)2223-based superconducting wire
12: Oxide superconducting filament
13: Sheath portion
20: Tape-shaped thin-film RE123-based superconducting wire
21: Metallic oriented substrate
22: Buffer layer
23: Superconducting thin-film layer
24: Stabilizing layer
25 and 26: Protection layer

Best Mode for Carrying out the Invention

Embodiments of the present invention are explained below based on the drawing. In the drawing, the ratios of the dimensions are not necessarily coincident with those of the explanation.

Embodiments

FIG. 1 is a partly cross-sectional perspective view schematically showing the structure of a tape-shaped (Bi, Pb)2223-based superconducting wire. By referring to FIG. 1, an explanation is given to a tape-shaped (Bi, Pb)2223-based superconducting wire having multiple filaments. A tape-shaped (Bi, Pb)2223-based superconducting wire 11 has a plurality of (Bi, Pb)2223-based superconducting filaments 12 and a sheath portion 13 that covers the filaments 12. The sheath portion 13 is composed of metal, such as silver or silver alloy.

Figure 2:
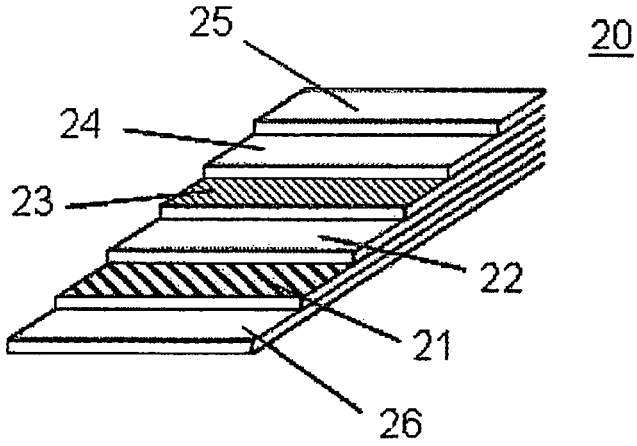
FIG. 2 is a partly cross-sectional perspective view schematically showing the structure of a tape-shaped thin-film RE123-based superconducting wire.

FIG. 2 is a partly cross-sectional perspective view schematically showing the structure of a tape-shaped thin-film RE123-based superconducting wire. By referring to FIG. 2, an explanation is given to a typical example of a tape-shaped thin-film RE123-based superconducting wire. A tape-shaped thin-film RE123-based superconducting wire 20 has a metallic oriented substrate 21 as the substrate, a buffer layer 22 formed on the metallic oriented substrate 21, a superconducting thin-film layer 23 formed on the buffer layer 22, a stabilizing layer 24 for protecting the superconducting thin-film layer 23, and protection layers 25 and 26 for protecting all the members and for improving the conducting performance when the superconducting wire 20 fails to maintain the superconducting state.

The metallic oriented substrate 21 can be, for example, a nickel oriented substrate or a nickel-alloy-based oriented substrate. The buffer layer 22 can be formed of oxide, such as $CeO_2$ or yttrium-stabilized zirconia (YSZ). The superconducting thin-film layer 23 is formed of RE123-based superconducting material such as $HoBa_2Cu_3O_x$ ("x" is a number close to 7). The stabilizing layer 24 and the protection layers 25 and 26 are formed by using silver (Ag) or copper (Cu).

Figure 3:
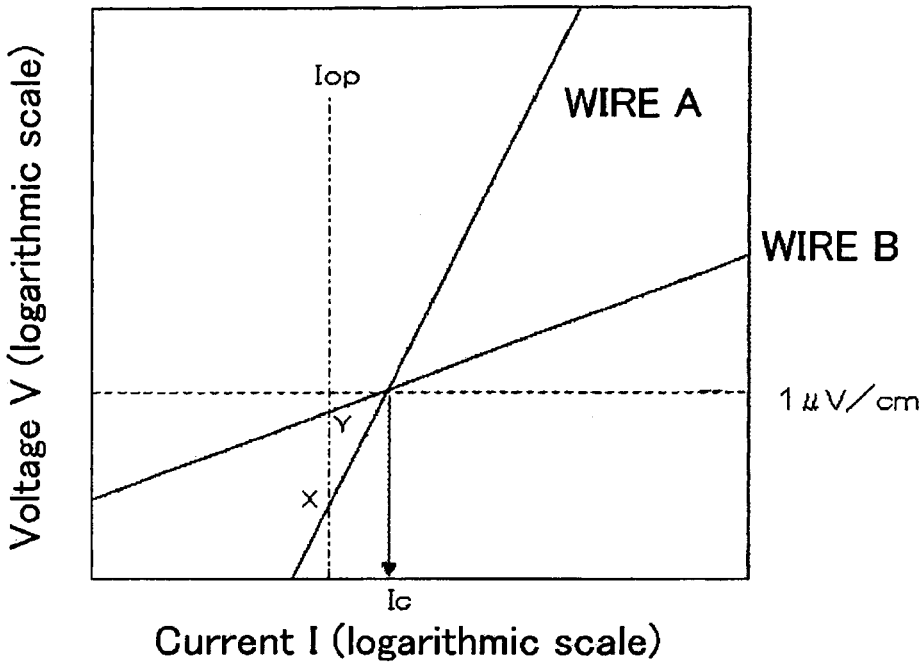
FIG. 3 is a diagram schematically expressing the current-voltage characteristic of a superconducting wire.

FIG. 3 is a diagram schematically expressing the current-voltage characteristic of a superconducting wire. Both the horizontal axis (for current) and the vertical axis (for voltage) are expressed on a logarithmic scale. A current-voltage curve of a superconducting wire expressed as $V \propto I^n$ (V: voltage, I: current) becomes almost linear when plotted on a scale as shown in FIG. 3. The exponent "n" (n-value) in the foregoing formula represents the gradient of the straight line. As the n-value increases, the gradient of the straight line increases.

The critical-current value (Ic) of a superconducting wire is defined as the current that generates a voltage of 1 μV/cm (expressed as the short dashed line in FIG. 3). Generally, a superconducting coil is operated at an operating current (Iop, expressed as the chain single-dashed line in FIG. 3) that is not more than the critical-current value. The operation is performed such that the heat generated by the generated voltage is balanced with the cooling capacity to maintain the temperature constant.

In FIG. 3, a wire A has a higher n-value and a wire B has a lower n-value. Both wires have the same Ic. Even under the condition of the same Ic, FIG. 3 shows that when an operating current not more than Ic flows, the wire A, which has a higher n-value, generates a lower voltage (the voltage at point X in FIG. 3) at that current. In other words, during an operation in a steady state, a superconducting coil structured by using a wire having a higher n-value can be operated more stably.

Figure 4:
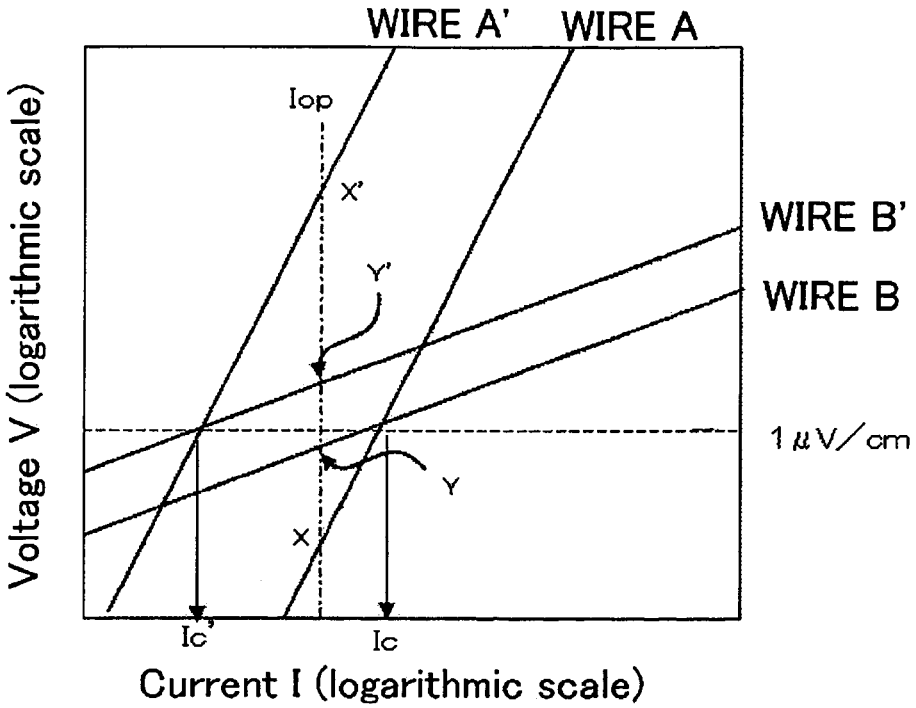
FIG. 4 is a diagram schematically expressing a variation in a current-voltage characteristic when an external disturbance enters.

On the other hand, while the operation is being in the above-described steady state, when an external disturbance enters for some reason, such as a temperature rise or an increase in the magnetic field, the critical-current value of the superconducting wire will decrease. FIG. 4 is a diagram schematically expressing a variation in the current-voltage characteristic when an external disturbance enters. When the temperature is raised or the magnetic field is intensified, for example, Ic of the superconducting wire will decrease. In FIG. 4, for the wire A, the current-voltage curve shifts from the straight line WIRE A to the straight line WIRE A', shifting Ic to Ic'. Similarly, for the wire B, the current-voltage curve shifts from the straight line WIRE B to the straight line WIRE B', decreasing Ic in a similar manner.

When the above-described shifting occurs, because the operating current (Iop) is maintained unchanged, for the wire A, the voltage is significantly increased from point X to point X' in FIG. 4. In the above description, point X is the point of intersection of the straight line WIRE A in the state of steady operation and the straight line representing the operating current, and point X' is the point of intersection of the straight line WIRE A' representing the current-voltage curve at the time the critical-current value is decreased and the straight line representing the operating current. Similarly, for the wire B, the voltage is increased from point Y to point Y'.

The occurring of the significant voltage variation from point X to point X' is a disadvantage of a wire having a higher n-value. Even in the superconducting state, a superconducting coil generates heat in accordance with the relationship H=V×I (H: heat, V: voltage, I: current). When the generated heat exceeds the cooling capacity, the temperature rise and the Ic decrease occur in succession like a chain reaction. As a result, the coil becomes unable to operate. This phenomenon is known as the quenching phenomenon.

On the other hand, for a wire having a lower n-value, even when Ic decreases at a comparable degree, the voltage increase is small as shown by the shift from point Y to point Y'. Consequently, the generated heat does not exceed the cooling capacity. This is an advantage of a wire having a lower n-value.

At present, the tape-shaped thin-film RE123-based superconducting wire has an n-value of about 30 at a temperature and magnetic field to be employed for a superconducting coil. On the other hand, the tape-shaped (Bi, Pb)2223-based superconducting wire has an n-value of 5 to 20 or so depending on the temperature and magnetic field. Therefore, the tape-shaped thin-film RE123-based superconducting wire is considered to be a wire having a high n-value, and the tape-shaped (Bi, Pb)2223-based superconducting wire is considered to be a wire having a low n-value.

It is possible to form a superconducting coil by using only either one of the above-described two types of wires. In this case, however, the coil has not only an advantage but also a disadvantage. To solve this problem, the present invention offers a superconducting coil formed by using a superconducting conductor composed of a tape-shaped (Bi, Pb)2223-based superconducting wire and a tape-shaped thin-film RE123-based superconducting wire that are electrically connected in parallel with each other.

The operation of the superconducting coil of the present invention is explained below by referring to FIG. 4. In a steady state (the state in which the critical-current value is expressed as Ic), of the two types of wires connected in parallel, the tape-shaped thin-film RE123-based superconducting wire, which has a lower resistance (equivalent to a lower generated voltage) and which is expressed as WIRE A in FIG. 4, carries nearly all the current. At this moment, the generated voltage has a value shown by point X. This generated voltage is lower than the generated voltage of a superconducting coil formed by singly using the tape-shaped (Bi, Pb)2223-based superconducting wire, whose characteristic is shown by the line WIRE B in FIG. 4 and whose generated voltage has a value shown by point Y When an external disturbance enters (the critical-current value is shifted to Ic'), the wire having a lower resistance at the same operating current is the tape-shaped (Bi, Pb)2223-based superconducting wire. Consequently, the current is transferred to the tape-shaped (Bi, Pb)2223-based superconducting wire. At that moment, the generated voltage is shifted to a value shown by point Y'. This generated voltage is lower than the generated voltage of a superconducting coil formed by singly using the tape-shaped thin-film RE123-based superconducting wire, whose characteristic at this moment is shown by the line WIRE A' in FIG. 4. As described above, the superconducting coil of the present invention generates only a low voltage both in the steady state and at the time an external disturbance enters. As a result, the coil can be operated more stably.

In the present invention, when the tape-shaped (Bi, Pb)2223-based superconducting wire has a first critical-current value at an operating temperature and magnetic field and the tape-shaped thin-film RE123-based superconducting wire has a second critical-current value at the operating temperature and magnetic field, it is desirable that the ratio of the first critical-current value to the second critical-current value be at least 0.8 and at most 1.25.

The critical-current value Ic of a superconducting wire varies depending on the temperature and magnetic field. Even when both wires have the same Ic at the liquid nitrogen temperature and zero magnetic field, the critical-current value Ic of each of the two wires differs from each other under the operating condition as a superconducting coil, for example, at a temperature of 30 K and a magnetic field of 3 T. The present invention is more effective when the two wires each have a critical-current value, Ic, closer to each other at the operating temperature and magnetic field.

Figure 5:
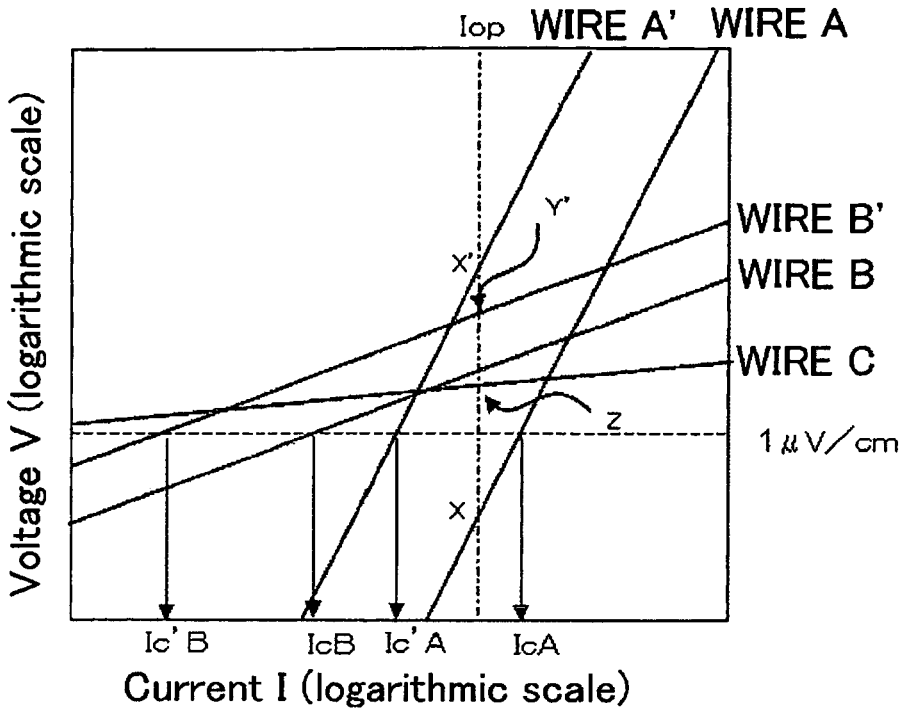
FIG. 5 is a diagram schematically expressing the current-voltage characteristics when wires each having a critical-current value, Ic, different from each other under the operating condition are connected in parallel.

FIG. 5 is a diagram schematically expressing the current-voltage characteristics when wires each having a critical-current value, Ic, different from each other under the operating condition are connected in parallel. Under some condition, a wire A (a wire having a high n-value) has a critical-current value of IcA and a wire B (a wire having a low n-value) has a critical-current value of IcB, which is lower than IcA. The superconducting coil is operated at a current of Iop. The voltage generated in the superconducting coil has a value shown by point X. Under this condition, when an external disturbance enters, the individual critical-current values are decreased from IcA to Ic'A and from IcB to Ic'B and the current-voltage characteristics, also, are shifted to the straight line WIRE A' and the straight line WIRE B', respectively. When the external disturbance enters, the superconducting coil generates a voltage having a value shown by point Y'. As can be seen from FIG. 5, when the wire having a low n-value has a low Ic, the voltage value at point X' and the voltage value at point Y' become closer to each other. In this case, the effect of limiting the generated voltage is not so significant. This phenomenon is dependent on the magnitudes of the n-values of the individual wires. As the n-value of the wire having a low n-value decreases, the gradient of the current-voltage characteristic of the wire having a low n-value decreases (in FIG. 5, the gradient of the straight line WIRE B' decreases). Consequently, even when Ic is considerably low, the generated voltage can be limited. The straight line WIRE C in FIG. 5 shows the case where the n-value is extremely low. In this case, the generated voltage has a value shown by point Z.

The tape-shaped (Bi, Pb)2223-based superconducting wire to be used in the present invention has an n-value of 20 or so under a certain temperature and magnetic-field condition. In this case, when the tape-shaped (Bi, Pb)2223-based superconducting wire has an Ic that is considerably different from that of the tape-shaped thin-film RE123-based superconducting wire, the effect becomes unsignificant. The present inventors have derived through calculation that in the case where the tape-shaped (Bi, Pb)2223-based superconducting wire has an n-value of 20 or so, when the ratio of the critical-current value of the tape-shaped (Bi, Pb)2223-based superconducting wire to that of the tape-shaped thin-film RE123-based superconducting wire is at least 0.8, the effect is greater.

Figure 6:
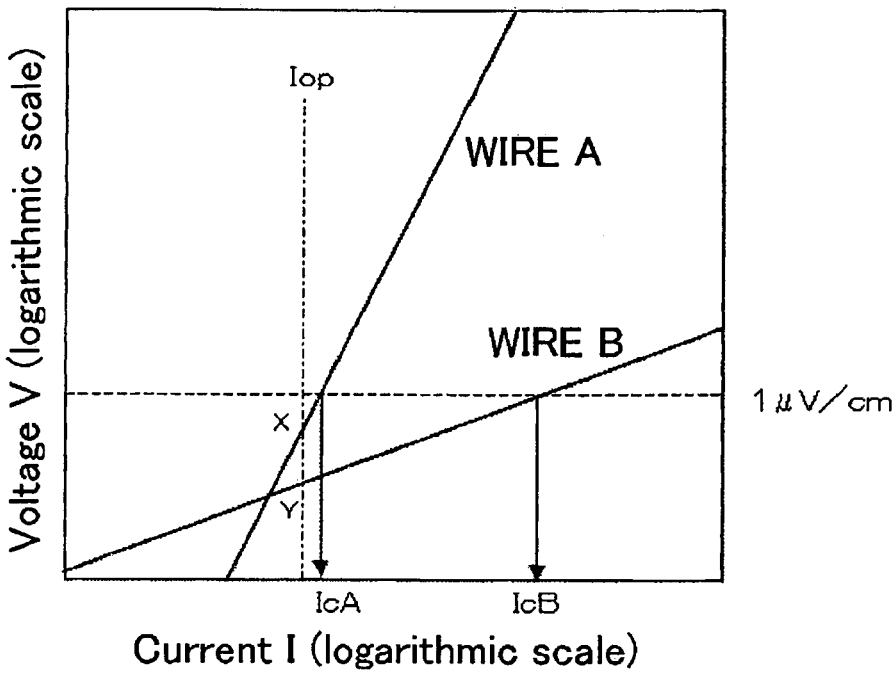
FIG. 6 is an another diagram schematically expressing the current-voltage characteristics when wires each having a critical-current value, Ic, different from each other under the operating condition are connected in parallel.

FIG. 6 is an another diagram schematically expressing the current-voltage characteristics when wires each having a critical-current value, Ic, different from each other under the operating condition are connected in parallel. FIG. 6 shows the case where a wire having a low n-value (the wire B) has an Ic higher than that of a wire having a high n-value (the wire A). As can be seen from FIG. 6, when the wire having a low n-value (the wire B) has a higher Ic, the relation between the generated voltages at an operating current (Iop) is sometimes reversed as shown by point X and point Y. When this reversion occurs, the wire having a high n-value (the wire A) does not carry the current. This phenomenon is dependent on the relation of the magnitudes of the n-values of the two wires. The present inventors have derived through calculation that based on the practical n-values of the tape-shaped (Bi, Pb)2223-based superconducting wire and the tape-shaped thin-film RE123-based superconducting wire both to be used in the present invention, when the ratio of the critical-current value of the tape-shaped (Bi, Pb)2223-based superconducting wire to that of the tape-shaped thin-film RE123-based superconducting wire is at most 1.25, the tape-shaped thin-film RE123-based superconducting wire will effectively carry the current.

In addition, according to the present invention, it is desirable that the tape-shaped (Bi, Pb)2223-based superconducting wire and the tape-shaped thin-film RE123-based superconducting wire have the same width. To cool the pancake-shaped superconducting coil, a metallic cooling plate having good thermal conductivity, such as a plate made of copper, is placed on the top surface of and directly under the undersurface of the pancake-shaped superconducting coil such that the cooling plate is brought into contact with the surface. In this case, when the contact area between the superconducting wire and the metallic cooling plate is larger, the superconducting coil can be cooled more effectively. In the case where the wires connected in parallel have different widths, when the wires are wound in the shape of a pancake, its cross section has the shape of a comb, producing gaps. The cooling plate is not brought into contact with some part of the wire having a narrower width. At the gap portion, no contact is provided between the wires in the neighboring turns. Because the gap portion has poor thermal conduction, the cooling efficiency is low. Therefore, it is desirable that the two wires to be conneted in parallel have the same width so that the top surface and undersurface of the pancake-shaped superconducting coil can be smooth without producing gaps.

According to the present invention, it is desirable that the tape-shaped (Bi, Pb)2223-based superconducting wire be mechanically bonded with the tape-shaped thin-film RE123-based superconducting wire throughout its length. To electrically connect the wires in parallel, both ends need only to be connected with solder or the like. The superconducting coil is desired to improve its mechanical strength in addition to the electrical properties. When the tape-shaped (Bi, Pb)2223-based superconducting wire and the tape-shaped thin-film RE123-based superconducting wire are compared with each other with respect to other properties than the superconducting properties such as the n-value, the tape-shaped thin-film RE123-based superconducting wire is more resistant to a tensile force applied from the outside. In the superconducting coil, the superconducting wire is subjected to a hoop tension (tensile force) due to electromagnetic force. When this tension is great, the superconducting portion in the wire may break. In the tape-shaped thin-film RE123-based superconducting wire, the metallic oriented substrate 21 combines the role of a reinforcing member, so that the wire can withstand an intense tensile force. Consequently, when the two wires are mechanically bonded with each other throughout their length with solder or the like so that the tape-shaped thin-film RE123-based superconducting wire can be used as a reinforcing member for the tape-shaped (Bi, Pb)2223-based superconducting wire, the strength of the entire superconducting conductor is increased. The bonding may be performed either by a discontinuous method, in which a bonded portion and an unbonded portion are provided periodically to a certain extent, for example, at one meter intervals or by a continuous method without gaps. Of course, this bonding may combine the role of electrical connection.

To improve the mechanical strength, the following two types of structure are effective. One structure is formed by winding the tape-shaped thin-film RE123-based superconducting wire so as to be positioned at the outer side in the same turn. In other words, when the superconducting coil of the present invention is formed, the conductor composed of two wires connected in parallel is wound such that the tape-shaped thin-film RE123-based superconducting wire is positioned at the outer side. When the pancake-shaped superconducting coil is formed, the superconducting wire is bent perpendicular to the face of the tape. At this moment, two types of force are applied as described below at the inside of the superconducting wire. First, the neutral line is drawn so as to pass through the center point of the thickness of the superconducting wire. Compressive force is applied to the inner side of the neutral line (the side to the center of bending), and tensile force is applied to the outer side of the neutral line. Being ceramic material, both the (Bi, Pb)2223-based superconducting material and the RE123-based superconducting material are more resistant to compressive force than to tensile force. Consequently, Ic is unlikely to decrease by the application of compressive force. In other words, when a bending process is performed, in the wire, Ic does not decrease at the inner side of the neutral line and Ic mainly decreases at the outer side of the neutral line. When the two wires are compared, because of its thin-film structure, the tape-shaped thin-film RE123-based superconducting wire is more resistant to bending. Therefore, in the case where the two wires are used to form a superconducting conductor in which the two wires are connected in parallel, when the superconducting coil is structured in such a way that the tape-shaped (Bi, Pb)2223-based superconducting wire is subjected to the compressive force, that is to say, the wire is positioned at the inner side of the neutral line of the superconducting conductor, the decrease in Ic due to the bending process becomes smaller.

As for the other structure, because of the reason similar to the above, it is desirable that the tape-shaped thin-film RE123-based superconducting wire be positioned such that the superconducting-layer side faces the tape-shaped (Bi, Pb)2223-based superconducting wire. The tape-shaped thin-film RE123-based superconducting wire has a layered structure that is asymmetrical in the direction of the thickness, because the superconducting layer is placed above the metallic oriented substrate. When the surface at the side where the superconducting layer exists is defined as the top surface and the surface at the side where the metallic oriented substrate exists is defined as the undersurface, the tape-shaped thin-film RE123-based superconducting wire is positioned such that the top surface is brought into contact with the tape-shaped (Bi, Pb)2223-based superconducting wire. Referring to FIG. 2, the superconducting conductor is structured such that the side of the protection layer 25 faces the tape-shaped (Bi, Pb)2223-based superconducting wire. When the two wires are positioned as described above, the superconducting layer of the tape-shaped thin-film RE123-based superconducting wire is positioned close to the neutral line of the superconducting conductor in which the two wires are connected in parallel. This positioning can materialize a structure in which the tensile force resulting from a bending process is less likely to be applied to the superconducting layer.

EXAMPLES

The present invention is explained below more specifically based on examples.

Example

The following two wires were prepared. One wire was a tape-shaped (Bi, Pb)2223-based superconducting wire having a width of 4.0±0.1 mm, a thickness of 0.25±0.01 mm, and a length of 10 m. The other wire was a tape-shaped thin-film RE123-based superconducting wire having a width of 4.00±0.05 mm, a thickness of 0.1±0.002 mm, and a length of 10 m. The tape-shaped (Bi, Pb)2223-based superconducting wire had a critical-current value of 190 A at a temperature of 30 K and a magnetic field of 1 T, the magnetic field being in parallel with the face of the tape. The tape-shaped thin-film RE123-based superconducting wire had a critical-current value of 200 A at the same temperature and magnetic field as above. A superconducting conductor having a length of 10 m was produced first by positioning the superconducting-layer side of the tape-shaped thin-film RE123-based superconducting wire to the side of the tape-shaped (Bi, Pb)2223-based superconducting wire and then by soldering the both ends of the two wires.

A polyimide tape, having a thickness of about 15 μm, for the interturn insulation was laid on top of the superconducting conductor. The conductor having the above-described structure was wound on a coil form such that the tape-shaped (Bi, Pb)2223-based superconducting wire was positioned at the inner side. Thus, a pancake coil having an inner diameter of 80 mm was produced.

A copper plate as a cooling plate was placed on the top surface of and directly under the undersurface of the foregoing pancake coil. The copper plate was connected to a cold head of a refrigerator through a heat-conducting bar to cool the coil. The superconducting coil was placed in a heat-insulated vacuum container. By controlling the output of the refrigerator, it was possible to set the temperature of the entire superconducting coil at any temperature down to 10 K or so. A preparation was made to apply an external magnetic field to the superconducting coil in parallel with the face of the tape.

Comparative Example 1

The tape-shaped (Bi, Pb)2223-based superconducting wire used in Example was singly used to produce a superconducting coil having the same inner diameter as that of the coil in Example. The produced coil was cooled as with the coil in Example.

Comparative Example 2

The tape-shaped thin-film RE123-based superconducting wire used in Example was singly used to produce a superconducting coil having the same inner diameter as that of the coil in Example. The produced coil was cooled as with the coil in Example.

The coils of Example and Comparative examples were cooled to a temperature of 30 K to test their current-carrying property. The test method is described below. First, the superconducting coil was cooled to 30 K and the temperature was stabilized. After the temperature was stabilized, an external magnetic field of 1 T was applied to the superconducting coil. Subsequently, a current of 150 A was injected into the superconducting coil to measure the generated voltage under this condition (this condition represents the steady-state operation). While maintaining the carrying current at 150 A, the external magnetic field was increased to 2 T (this condition represents an external disturbance). Under this condition, the generated voltage was measured. The obtained results are shown in Table I. The generated voltage is shown by a voltage per unit length (μV/cm).

TABLE I (Unit: μV/cm)

| External magnetic field | Example | Comparative example 1 | Comparative example 2 |
|---|---|---|---|
| 1 T | 0.011 | 0.07 | 0.012 |
| 2 T | 11 | 9 | 200 |

As can be seen from Table I, when a magnetic field of 1 T is applied to simulate the steady-state operation, the generated voltage is low in Example and Comparative example 2, both of which include the tape-shaped thin-film RE123-based superconducting wire. On the other hand, when a magnetic field of 2 T is applied to simulate a state where an external disturbance enters, the generated voltage is lower in Example and Comparative example 1, both of which include the tape-shaped (Bi, Pb)2223-based superconducting wire, than in Comparative example 2, which does not include the wire.

It is to be considered that the above-disclosed embodiments and example are illustrative and not restrictive in all respects. The scope of the present invention is shown by the scope of the appended claims, not by the above-described explanations. Accordingly, the present invention is intended to cover all revisions and modifications included within the meaning and scope equivalent to the scope of the claims.

Industrial Applicability

The superconducting coil of the present invention is formed by using a superconducting conductor composed of a tape-shaped (Bi, Pb)2223-based superconducting wire and a tape-shaped thin-film RE123-based superconducting wire that are connected in parallel with each other. This structure can exploit the properties of the two wires. This feature can realize a superconducting coil that generates only a low voltage both in the steady-state operation and at the time of undergoing an abnormal condition.

The invention claimed is:

1. A superconducting coil, having the shape of a pancake formed by winding a superconducting conductor;

the superconducting conductor comprising a tape-shaped (Bi, Pb)2223-based superconducting wire and a tape-shaped thin-film RE123-based superconducting wire that are electrically connected in parallel with each other;

wherein:

(a) the tape-shaped (Bi, Pb)2223-based superconducting wire has a first critical-current value at an operating temperature and magnetic field;

(b) the tape-shaped thin-film RE123-based superconducting wire has a second critical-current value at the operating temperature and magnetic field; and (c) a ratio of the first critical-current value to the second critical-current value is at least 0.8 and at most 1.25, and a ratio of an n-value of the tape-shaped (Bi, Pb)2223-based superconducting wire to that of the tape-shaped thin-film RE123-based superconducting wire is at least ⅙ and at most ⅔, wherein the n-value is a coefficient value of current in a current-voltage characteristic which is expressed as $V \propto I^n$, V-voltage and I-current.

2. The superconducting coil as defined by claim 1, wherein the tape-shaped (Bi, Pb)2223-based superconducting wire and the tape-shaped thin-film RE123-based superconducting wire have the same width.

3. The superconducting coil as defined by claim 1, wherein the tape-shaped (Bi, Pb)2223-based superconducting wire is mechanically bonded with the tape-shaped thin-film RE123-based superconducting wire throughout its length.

4. The superconducting coil as defined by claim 1, wherein in the same turn, the tape-shaped thin-film RE123-based superconducting wire is wound at the outer side.

5. The superconducting coil as defined by claim 4, wherein:

(a) the tape-shaped thin-film RE123-based superconducting wire has a superconducting layer; and (b) the superconducting-layer side of the tape-shaped thin-film RE123-based superconducting wire is positioned so as to face the tape-shaped (Bi, Pb)2223-based superconducting wire.

6. A superconducting conductor structurally configured so as to be used for the superconducting coil as defined by claim 1;

the superconducting conductor comprising a tape-shaped (Bi, Pb)2223-based superconducting wire and a tape-shaped thin-film RE123-based superconducting wire that are electrically connected in parallel with each other, wherein:

(a) the tape-shaped (Bi, Pb)2223-based superconducting wire has a first critical-current value at an operating temperature and magnetic field;

(b) the tape-shaped thin-film RE123-based superconducting wire has a second critical-current value at the operating temperature and magnetic field; and (c) a ratio of the first critical-current value to the second critical-current value is at least 0.8 and at most 1.25, and a ratio of an n-value of the tape-shaped (Bi, Pb)2223-based superconducting wire to that of the tape-shaped thin-film RE123-based superconducting wire is at least ⅙ and at most ⅔, wherein the n-value is a coefficient value of current in a current-voltage characteristic which is expressed as $V \propto I^n$, V-voltage and I-current.

* * * * *